US006059537A

United States Patent [19]

Cygnor

[11] Patent Number: 6,059,537

[45] Date of Patent: May 9, 2000

[54] AIRCRAFT FUEL PUMP WITH CENTRIFUGAL PUMP AND REGENERATIVE PUMP STAGES

[75] Inventor: John Edward Cygnor, Rockford, Ill.

[73] Assignee: Sundstrand Corporation, Rockford, Ill.

[21] Appl. No.: 08/980,863

[22] Filed: Nov. 13, 1997

[51] Int. Cl.[7] ..... F04B 23/14

[52] U.S. Cl. ..... 417/203; 417/308; 60/734

[58] Field of Search ..... 417/203, 308; 60/734

[56] References Cited

U.S. PATENT DOCUMENTS

| | | | |
|---|---|---|---|
| 4,247,263 | 1/1981 | Pech et al. | 417/203 |
| 4,607,486 | 8/1986 | Cole | 60/734 |
| 4,700,680 | 10/1987 | Pearce | 417/383 |
| 4,869,642 | 9/1989 | Williamson et al. | 415/146 |
| 4,926,629 | 5/1990 | Eick et al. | 60/39.281 |
| 5,456,574 | 10/1995 | Donnelly et al. | 415/28 |
| 5,495,715 | 3/1996 | Loxley | 60/734 |

*Primary Examiner*—Timothy S. Thorpe
*Assistant Examiner*—Ehud Gartenberg
*Attorney, Agent, or Firm*—Wood, Phillips, VanSanten, Clark & Mortimer

[57] ABSTRACT

A fuel pressurization and pumping system for use in a turbine powered aircraft or the like makes use of the advantages of centrifugal pumps, even in a high pressure mode and includes a centrifugal volute pump (24) having a fuel inlet (28) and fuel outlet (32) along with a regenerative pump (34) having a fuel inlet (36) and a fuel outlet (38). The fuel outlet (32) of the centrifugal volute pump (24) is connected to the fuel inlet (36) of the regenerative pump (34) and a valve (50) is provided for blocking flow from the centrifugal volute pump (24) to the regenerative pump (34). A first pressure regulator (56) is connected to regenerative pump outlet (38) for maintaining pressure thereat at a relatively low elevated level and a second pressure regulator (130) is connected to the regenerative pump outlet (38) for maintaining pressure thereat at a relatively high elevated level. A valve system (66), (90) is provided for selectively disabling the first pressure regulator (56).

12 Claims, 2 Drawing Sheets

AIRCRAFT FUEL PUMP WITH CENTRIFUGAL PUMP AND REGENERATIVE PUMP STAGES

FIELD OF THE INVENTION

This invention relates to centrifugal pumps, and more particularly, to centrifugal pumps intended for use in high performance, turbine powered aircraft.

BACKGROUND OF THE INVENTION

It has long been desirable to employ high speed centrifugal pumps as fuel pumps in aircraft employing turbine engines. Fuels used in aircraft turbine engines are typically of low lubricity and centrifugal pumps are ideally suited for pumping such liquids without excessive wear, particularly if the fuel itself may be used as a lubricant thereby eliminating circuits for lubricating oil. As can be imagined, when a lubricating oil circuit is avoided, pump weight, volume, and complexity are all reduced.

In many cases, for a given pumping capacity at rated engine speed, a centrifugal pump will occupy a considerably lesser volume than a typical positive displacement pump used for the same purpose. Usually, this reduction in volume will translate into a weight savings as well.

As the reduction of the size of the envelope occupied by a given component is reduced, the aircraft designer is provided with greater flexibility in achieving an aerodynamically slippery design. Consequently, a smaller envelope made possible by reduced size of a component raises the potential for more efficient operation of aircraft through the reduction in drag.

At the same time, the accompanying weight reduction enables aircraft range to be increased. The weight carrying capability of the aircraft heretofore devoted to transporting a positive displacement fuel pump can, in part, be used to increase fuel carrying capacity and/or other pay loads.

Notwithstanding the foregoing, centrifugal pumps as fuel pumps in turbine powered aircraft have not yet received an appreciable degree of utilization for the purpose. Conventional centrifugal volute pumps do not have the ability to provide fuel flow at high pressure at low engine speeds, particularly during engine starting sequences. Moreover, many high performance aircraft today include components, such as nozzles, that are altered during engine operation to achieve a change in performance. These alterations are conventionally achieved hydraulically and it is not unusual for pressures of the hydraulic fluid to be at a level of approximately 2500 psig. While this can be obtained through the use of hydraulic circuits using conventional hydraulic fluids, to eliminate complexity and for other obvious reasons, modern day aircraft employ fuel at high pressure as the hydraulic fluid since it is continually being consumed by the engine and therefore is not subject to coking as would be the case with conventional hydraulic oils in separate hydraulic circuits.

As one might well imagine, when changes in engine geometry are required to change aircraft performance, virtually immediate response to a command for geometry alteration is required. This cannot be achieved using conventional centrifugal volute pumps operating at engine speed with the consequence that other means must be employed, adding complexity, weight and component volume to the aircraft.

The present invention is directed to overcoming one or more of the above problems.

SUMMARY OF THE INVENTION

It is the principal object of the invention to provide a new and improved pump. More specifically, it is an object of the invention to provide an all centrifugal pump for use as a fuel pump in turbine powered aircraft and which is capable of responding substantially instantaneously to the requirement for highly pressurized fuel needed to alter engine geometry at high performance, turbine powered aircraft.

An exemplary embodiment of the invention achieves the foregoing objects in a construction that includes a centrifugal volute pump having a fuel inlet and a fuel outlet along with a regenerative pump having a fuel inlet and a fuel outlet. The fuel outlet of the centrifugal volute pump is connected to the fuel inlet of the regenerative pump and a valve is provided for blocking flow from the centrifugal volute pump to the regenerative pump. A first pressure regulator is connectable to the regenerative pump outlet for maintaining pressure thereat at a relatively low elevated level and a second pressure regulator is connected to the regenerative pump outlet for maintaining pressure thereat at a relatively high elevated level. Means are provided for selectively disabling the first pressure regulator.

As a consequence of this construction, the regenerative pump is operable to provide fuel pressures of adequate elevation even at low engine speeds as during start up while, at normal operating engine speeds such as engine idle and above, fuel under adequate pressure is provided by the centrifugal volute pump. While the regenerative pump is disabled by having flow from the centrifugal volume pump thereto blocked.

When it is necessary to provide fuel at a relatively high elevated pressure, as, for example, to operate engine geometry changing, fuel operated hydraulic systems, the regenerative pump may be reenabled to provide fuel at highly elevated pressures.

In one embodiment of the invention, at least one of the regulators is a pressure relief valve.

In a preferred embodiment, an ejector is provided and means are included for selectively connecting the ejector to the regenerative pump. Thus, when the regenerative pump is disabled, the ejector may be utilized to evacuate the same to avoid any build-up of fluid under pressure therein as well as to eliminate the need for any expenditure of pumping energy on fluid contained therein.

In a highly preferred embodiment, the means for selectively connecting the ejector to the regenerative pump comprises a valve having a pressure responsive surface connected to the centrifugal volute pump outlet to be responsive to the pressure thereat.

In a highly preferred embodiment, a pump housing is included and the same includes first and second cavities. A shaft is journalled in the housing and is located in the cavities. First and second impellers are located within respective ones of the cavities and on the shaft. The first cavity and first impeller define the centrifugal volume pump and the second cavity and second impeller define the regenerative pump.

In one embodiment of the invention, the blocking valve is a pressure responsive valve and the system further includes a first means responsive to the pressure at the centrifugal volute pump outlet for closing the blocking valve when a predetermined pressure is achieved and a second means responsive to a signal requiring the generation of high fuel pressures for overriding the first means.

Other objects and advantages will become apparent from the following specification taken in connection with the accompanying drawings.

DESCRIPTION OF THE PREFERRED EMBODIMENT

Figure 1:
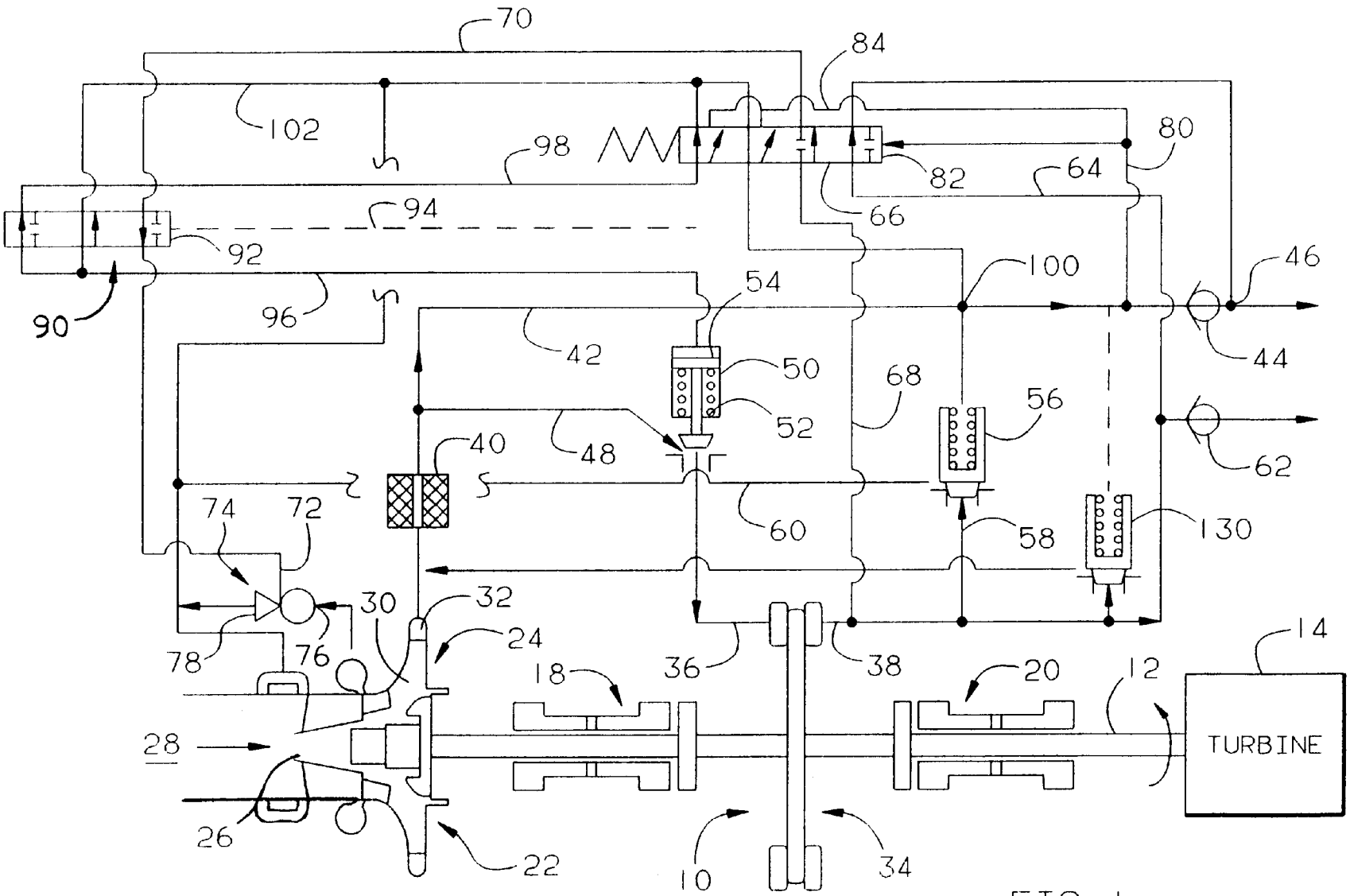
FIG. 1 is a schematic of a fuel pressurization and pumping system for use with a turbine engine and made according to the invention.

An exemplary embodiment of a pumping system made according to the invention is illustrated in FIG. 1 and with reference thereto is seen to include a pump, generally designated 10, having a shaft 12, connected to be driven by a turbine engine 14 at speeds typically in the range of 25,000–40,000 RPM. To this end, the shaft 10 is journalled within a housing, generally designated 16 (FIG. 2) by first and second hydrostatic bearings, generally designated 18 and 20, respectively. The bearings 18 and 20 may be of the form disclosed in the commonly assigned application of Cygnor, et al., (assignee's internal docket number B05209-AT3-USA) entitled "High Speed Self-Lubricated Fuel Pump With Hydrostatic Bearings", Ser. No. 08/970,850, filed Nov. 19, 1997, (attorneys docket number 875.00240), the entire disclosure of which is herein incorporated by reference. For present purposes it is sufficient to note that the bearings 18 and 20 are connected to receive the outlet pressure of the pump 10 so that as pump speed increases, centering pressure of the fluid at the bearings 18, 20 is likewise increased. Furthermore, because pump outlet pressure is utilized, the bearings 18 and 20 are lubricated by the pumped fluid itself, namely fuel, such that the pump 10 does not require a separate hydraulic fluid lubricating system. Long life and lightweight are accordingly obtained.

The pump 10 includes two pumping stages. A first includes a conventional, centrifugal volute pump, generally designated 24, provided with an appropriate inducer configuration 26 which may be of conventional configuration and a fuel inlet 28. The centrifugal volute pump 24 includes an impeller 30 mounted on the shaft 12 for rotation therewith along with a peripheral volute 32 which serves as the outlet for the centrifugal volute pump 24.

It is to be noted that the centrifugal volute pump 24 acts as the main stage of the pump 10.

On the opposite side of the bearing 18, and between the bearings 18 and 20, there is located a conventional regenerative pump, generally designated 34. The regenerative pump 34 may be of the configuration disclosed in commonly assigned U.S. Pat. No. 5,096,386, issued Mar. 17, 1992 to Kassel and No. 5,265,996, issued Nov. 30, 1993 to Westhoff, et al. The entire disclosures of both such patents are herein incorporated by reference. As is well known, a regenerative pump will pump fluid at 2½–3 times the head of a similar centrifugal volute pump and thus the presence of the regenerative pump 34 provides a means whereby adequate fuel pressures may be obtained even at extremely low engine speeds such as 10% engine speed, as are encountered during starting procedures. As will be seen, the regenerative pump 34 is also used to substantially instantaneously provide extremely high fuel pressures that are required for operating engine geometry altering, fuel operated hydraulic systems.

Schematically illustrated in FIG. 1 at 36 is an inlet to the regenerative pump. An outlet is schematically shown at 38.

The volute 32 of the centrifugal volute pump 24 is connected via a filter 40 to a line 42 which extends to a check valve 44. A junction 46 at the downstream side of the check valve 44 may be connected to a point of use of the fuel such as engine combustors, engine augmenters (afterburners), or engine geometry alternating, fuel operated hydraulic systems.

The line 42 is also connected via a line 48 to a normally opened, pressure responsive inlet shut off valve 50 for the regenerative pump 34. That is to say, the valve 50 will normally be maintained in an open condition by an internal spring 52 until such time as a fluid pressure is applied against an internal fluid pressure responsive surface 54. When the latter is pressurized, the valve 50 will close interrupting fluid communication between the volute 32 and the inlet 36 of the regenerative pump 34. However, when pressure is not applied to the surface 54, the valve 50 will be opened by action of the spring 52 and the volute 32 will be connected to the inlet 36 so that fuel pumped by the centrifugal volute pump 24 will be applied to the inlet 36 of the regenerative pump 34.

The outlet 38 of the regenerative pump 34 is connected to a pressure regulating valve 56 by a line 58. The pressure regulating valve 56 is typically set to open at a value that will maintain a pressure differential across the regenerative pump 34 of about 200 psi. When the pressure regulating valve 56 opens, excess fuel is passed on a line 60 back to the inlet of the inducer 26 of the centrifugal volute pump 24.

The function of the valve 56 is to assure adequate pressure for sequences such as starting sequences.

The outlet 38 is connected to the upstream side of a check valve 62 whose downstream side is adapted to be connected to those engine geometry alternating, fuel operated hydraulic systems that require extremely high pressures, i.e., 2500 psi. It is also connected via a line 64 to a pressure responsive spool valve 66. The normal position of the spool valve is that illustrated in FIG. 1 and when such is the case, the outlet 38 of the regenerative pump 34 is connected to the junction 46 to provide fuel under pressure thereto at a value of about 200 psi greater than the pressure at the inlet 36.

An ejector line 68 is also connected to the valve 66. The valve 66 may connect the line 68 to a line 70 which in turn extends to the ejector inlet 72 of a conventional ejector, generally designated 74. The ejector 74 includes a pressure fluid inlet 76 and an ejector outlet 78, the latter being connected to the inlet of the inducer stage 26 of the centrifugal volute pump 24. The pressure fluid inlet 76 is connected to a source of pressure within the centrifugal volute pump 24 and as is well known, fluid under pressure will flow from the inlet 76 the outlet 78 through a chamber, typically including a venturi-like configuration, which will cause a reduced pressure at the location of the ejector fluid inlet 72. As a consequence of this construction, the low pressure at the ejector 74 may be applied to the outlet 38 of the regenerative pump 34 to thereby evacuate any fluid therein.

The line 42 is also connected via a line 80 to the pressure responsive surface 82 of the valve 66 as well as to a line 84 for purposes to be seen.

The system includes a further spool valve, generally designated 90, which might be termed a high pressure fuel hydraulic transition valve. As seen in FIG. 1, it is shown in it's low pressure condition and the same includes a spool having a pressure responsive surface 92. The surface 92 is adapted to receive a pilot signal on a line 94 which may come from any suitable source. The pilot signal on the line 94 will be applied when it is desired to cause the system to enter the high pressure mode to generate extremely high fuel pressures to achieve alteration of engine geometry.

As can be seen from FIG. 1, in the low pressure position illustrated, the valve 90 allows connection of the line 70 to the ejector 72. Conversely, when a high pressure signal is received on the line 94, the resulting shifting of the spool of the valve 90 will disable the ejector 72 by cutting it off from it's connection to the outlet 38 of the regenerative pump 34.

The valve 90 also controls the application of pressure on a line 96 which is connected to the pressure responsive surface 54 of the regenerative pump inlet shut-off valve 50. Specifically, the valve 90 controls the connection of the line 96 to a line 98 which in turn may be connected via the valve 66 to the line 42 at a junction 100. The junction 100 is also connected to the pressure relief valve 56.

In addition, the valve 90 may connect the line 96 to a line 102 which can be connected to both the line 98 and the junction 100 via the valve 66 when conditions require.

Figure 2:
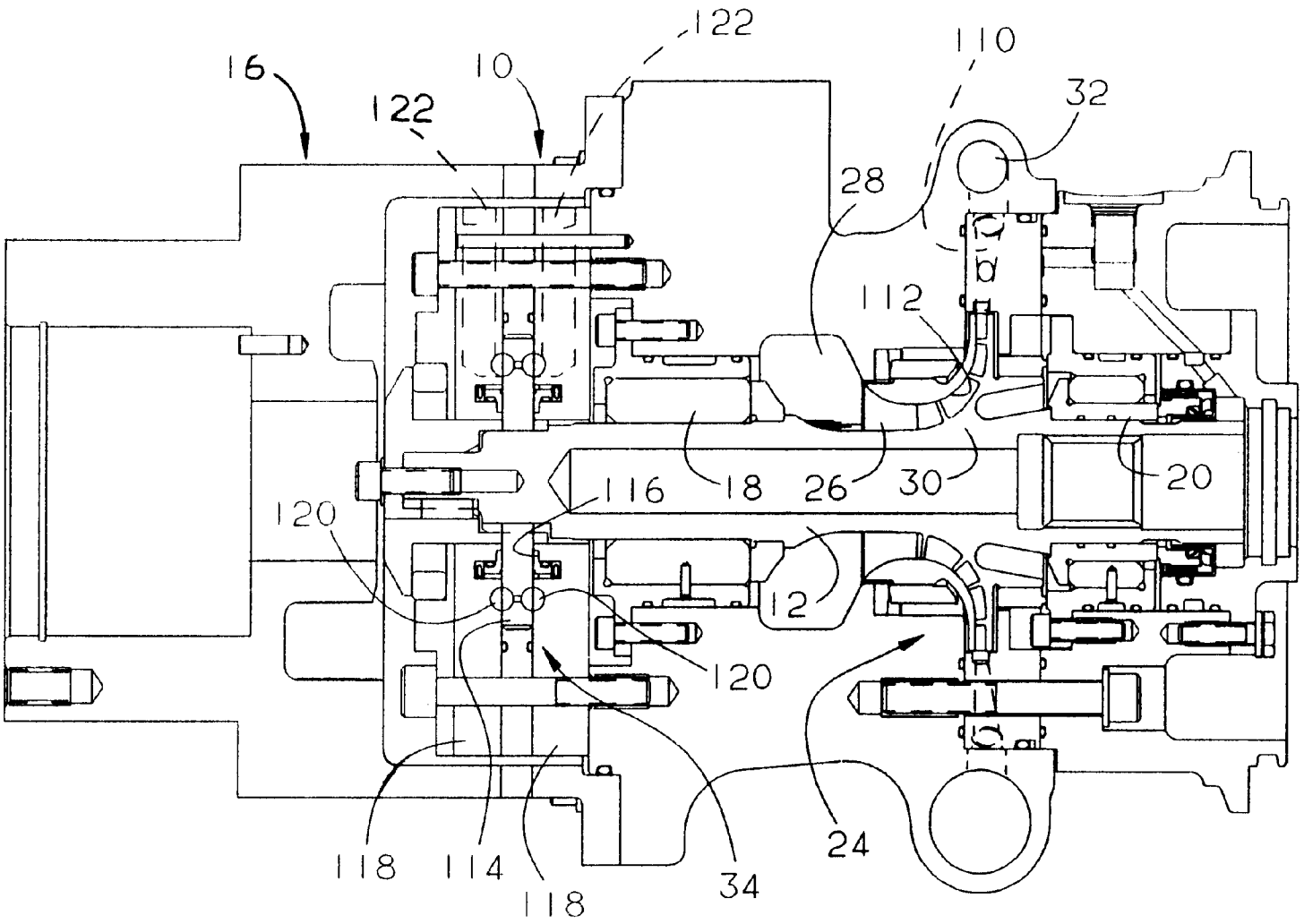
FIG. 2 is a sectional view of a pump used in the invention.

FIG. 2 shows in somewhat greater detail, the mechanical construction of the pump 10. For example, the impeller 30 is seen to discharge through a diffuser 110 to the volute 32. The shaft 12 is seen to be a single shaft mounting both the impeller 30 within a pumping cavity 112 and the impeller 114 of the regenerative pump 34 within a cavity 116. The cavity 116 is, in part, defined by a pair of side plates 118 having peripheral channels 120. Inlet and outlet paths, separated by a baffle in the channels 120 as is conventional are illustrated at 122 and 124 respectively.

The system includes a second fuel pressure regulator 130 which is connected to the outlet 38. This regulator 130 is set to regulate outlet pressure at an approximately 2500 psi pressure differential and as a consequence, fuel at this high pressure may flow through the check valve 62 to the high pressure fuel operated hydraulic systems of the aircraft. When such high pressure fuel is not required, the signal 94 is removed and the valve 90 returns to the position illustrated in FIG. 1, halting the flow of fuel to the inlet 36 of the regenerative pump 34 and again connecting the ejector 72 to the outlet 38.

Operation is generally as follows.

In normal operation, the turbine engine 14 will be operating at at least idle speed or greater and the centrifugal volute pump 24 will be providing fuel at an elevated pressure sufficient for normal engine operations on the line 42 from which the fuel may be conveyed to the various engine systems mentioned previously. This will result in pressurized fuel being applied against the pressure responsive surface 82 of the valve 66 which will shift from the position illustrated. This will, in turn, block the connection of the regenerative pump outlet 38 to the junction 46 via the line 64. It will also cause the outlet 38 to be connected via the lines 66 and 70 to the ejector 72 to evacuate the regenerative pump 34 to prevent pressure build-up therein and to avoid the wasting of pump energy. The line 80, via the line 84, will also be connected to the line 98. With the valve 90 in it's low pressure position as illustrated in FIG. 1, this means pressurized fuel from the volute 32 will be applied to the line 96 and ultimately to the pressure responsive surface 54 to close the regenerative pump inlet valve 50 so that no additional fluid can be admitted thereto while the evacuation is going on.

In summary, then, normal engine operations will be provided with fuel at the pressure at the outlet 34 with the regenerative pump 34 being effectively cut-out of and isolated from the remainder of the system.

In the event there becomes a demand for high pressure fuel to operate fuel operated hydraulic systems for altering engine geometry or the like, a signal is applied on the line 94 to shift the valve 90 from the position illustrated in FIG. 1. Communication between the lines 98 and 96 will be immediately halted, relieving the application of pressure to the pressure responsive surface 54 of the regenerative pump inlet shut-off valve 50 allowing the same to open under the influence of the spring 52. Fuel under pressure from the volute 32 will now be applied to the inlet 36 of the regenerative pump 34.

At the same time, fluid communication between the ejector 74 and the lines 70 and 68 will be halted, meaning that the ejector will cease evacuating the regenerative pump 34.

As a consequence, the regenerative pump 34 will be enabled and inasmuch as all will be occurring at a time when the centrifugal volute pump 24 is producing adequate fuel pressure for normal engine operations, it will be readily appreciated that the regenerative pump 34 will almost instantaneously provide fuel at extremely high pressure sufficient to operate fuel operated hydraulic systems. For that to occur, however, the fuel regulator 56 must remain closed and this is accomplished by it's connected to the junction 100 whereat the pressure at the volute 32 is sufficient to maintain the fuel regulating valve 56 in a closed position. At the same time, the regulator 130 acts to regulate the fuel pressure differential at the desired level, typically 2500 psi.

It will be readily recognized that with the pump of the present invention, energy is not expended to generate high fuel pressures except on those occasions when demanded as indicated by the presence of the signal 94.

In the start mode, both of the valves 66 and 90 are in the position illustrated. As the turbine 14 is cranked, as by an appropriate starter, the shaft 20 will begin to rotate. At this point, and perhaps up to 10% or 12% of rated speed, the pressure differential across the inlet 28 and the volute 32 of the centrifugal volute pump 24 will only be a couple of psi's. Nonetheless, because the regenerative pump inlet valve 50 is normally open, fuel will be provided to the inlet 36 of the regenerative pump 34. Because the pump 34 is a regenerative pump, it will be immediately capable of providing a pressure differential of 200 lbs per square inch even at low percentages of rated speed as are encountered during starting. As shaft speed 12 increases, the pressure is maintained substantially constant at the desired differential through operation of the pressure regulating valve 56. At this point in time, it will be appreciated that the pressure at the junction 100, which mirrors that at the volute 32 will remain relatively low and insufficient to lock the valve 56 in a closed position until substantial speeds are obtained.

As pressure begins to increase with increasing shaft speed, the valve 66 will transition to the run mode. Specifically, increasing pressure on the line 80 will begin to shift the spool of the valve 66 to the left as viewed in FIG. 1 in response to the application of increasing pressure on the pressure responsive surface 82. The valve 66 will begin to throttle flow between the line 64 and junction 46 to provide a smooth transition as the check valve 44 opens in response to the increasing pressure on the line 42.

As the valve 66 continues to shift to the left, it will cause the regenerative pump inlet valve 50 to close as a consequence of outlet pressure of the pump 24 being applied from the junction 100 through the valve 66 to the line 94, through the valve 90 to the line 96 and then to the pressure responsive surface 54 of the regenerative pump inlet valve 50.

The valve 66 is constructed to achieve the foregoing sequence as well as to thereafter cause complete closing of the connection between the line 64 and the junction 46, thereby shutting off the regenerative pump 34 from the engine.

At the next stage of the sequence, the valve 66 will begin to connect the line 68 to the line 70 so that the ejector 74 may evacuate the regenerative pump 34.

That being accomplished, the valve 66 connects the junction 100 to the line 84 which has the effect of raising the pressure applied to the regulator valve 56 sufficiently so that it is locked shut to be maintained closed even when the system shifts into the high pressure mode.

From the foregoing, it will be appreciated that a system made according to the invention advantageously employs centrifugal pumps for their benefits in terms of long life, reduced weight and reduced volume. Moreover, the same operates efficiently, requiring pumping energy for high pressure only when high pressure is demanded by the system.

I claim:

1. A fuel pressurization and pumping system for use on turbine powered aircraft or the like, comprising:

a centrifugal volute pump having a fuel inlet and a fuel outlet;

a regenerative pump having a fuel inlet and a fuel outlet;

the fuel outlet of said centrifugal volute pump being connected to the fuel inlet of said regenerative pump;

a valve for blocking flow from said centrifugal volute pump to said regenerative pump;

a first pressure regulator connected to said regenerative pump outlet for maintaining pressure thereat at a relatively low elevated level;

a second pressure regulator connected to said regenerative pump outlet for maintaining pressure thereat at a relatively high elevated level; and means for selectively disabling said first pressure regulator.

2. The fuel pressurization and pumping system of claim 1 wherein at least one of said regulators is a pressure relief valve.

3. The fuel pressurization and pumping system of claim 1 further including an ejector; and means for selectively connecting said ejector to said regenerative pump.

4. The fuel pressurization and pumping system of claim 3 wherein said selective connecting means comprises a valve having a pressure responsive surface connected to said centrifugal volute pump outlet.

5. The fuel pressurization and pumping system of claim 1 including a pump housing, first and second cavities in said housing, a shaft journalled in said housing and located in said cavities, and first and second impellers on said shaft within respective ones of said cavities, said first cavity and first impeller defining said centrifugal volute pump and said second cavity and second impeller defining said regenerative pump.

6. The fuel pressurization and pumping system of claim 1 wherein said valve for blocking flow is a pressure responsive valve; and further including first means responsive to the pressure at said centrifugal volute pump outlet for closing said blocking valve when a predetermined pressure is achieved; and second means responsive to a signal for overriding said first means.

7. A fuel pressurization and pumping system for use on turbine powered aircraft or the like, comprising:

a centrifugal volute pump having a fuel inlet and a fuel outlet;

a regenerative pump having a fuel inlet and a fuel outlet;

the fuel outlet of said centrifugal volute pump being connected to the fuel inlet of said regenerative pump;

a valve for blocking flow from said centrifugal volute pump to said regenerative pump;

a first pressure regulator connected to said regenerative pump outlet for maintaining pressure thereat at a relatively low elevated level;

a second pressure regulator connected to said regenerative pump outlet for maintaining pressure thereat at a relatively high elevated level;

means for selectively disabling said first pressure regulator;

a first means for closing said blocking valve when pressure at said centrifugal volute pump outlet exceeds a predetermined relatively low level; and second means for opening said blocking valve even when pressure at said centrifugal volute pump outlet exceeds said predetermined relatively low level when fuel at said relatively high elevated level is required.

8. The fuel pressurization and pumping system of claim 7 wherein said blocking valve is a pilot operated valve and said first means is a first valve operable to provide a pilot signal to close said blocking valve and said second means is a second valve operable to block said pilot signal.

9. The fuel pressurization and pumping system of claim 8 wherein said first valve includes a pressure responsive surface connected to said centrifugal volute pump outlet.

10. The fuel pressurization and pumping system of claim 9 further including an ejector adapted to be connected to said regenerative pump for evacuating the same and said first valve includes means for connecting said ejector to said regenerative pump when pressure at said centrifugal volute pump exceeds said predetermined relatively low level.

11. The fuel pressurization and pumping system of claim 10 wherein said second valve is operable to disconnect said ejector from said regenerative pump when fuel at said relatively high elevated level is required.

12. A fuel pressurization and pumping system for use on turbine powered aircraft or the like, comprising:

a centrifugal volute pump having a fuel inlet and a fuel outlet;

a regenerative pump having a fuel inlet and a fuel outlet;

the fuel outlet of said centrifugal volute pump being connected to the fuel inlet of said regenerative pump;

a valve for blocking flow from said centrifugal volute pump to said regenerative pump;

a first pressure regulator connected to said regenerative pump outlet for maintaining pressure thereat at a relatively low elevated level;

a second pressure regulator connected to said regenerative pump outlet for maintaining pressure thereat at a relatively high elevated level;

means for selectively disabling said first pressure regulator;

an ejector connected to said regenerative pump;

a first transition valve means having a pressure responsive surface connected to said centrifugal volute pump outlet to sense outlet pressure and a) connected to said regenerative pump outlet a for throttling flow therefrom with increasing outlet pressure, b) connected to said pressure responsive valve to block flow to said regenerative pump inlet at a predetermined outlet pressure; c) connected to said regenerative pump outlet to halt flow therefrom, d) connecting said ejector to said regenerative pump after flow to said regenerative pump has been blocked, and e) connected to said disabling means to disable said first regulator; and second transition valve means for a) selectively opening said blocking valve, and b) selectively disconnecting said ejector from said regenerative pump in response to a signal for demand for fuel at said relatively high elevated level.

* * * * *